US007982691B2

(12) United States Patent
Choi et al.

(10) Patent No.: US 7,982,691 B2
(45) **Date of Patent: *Jul. 19, 2011**

(54) DATA DRIVER, LIGHT EMITTING DISPLAY DEVICE USING THE SAME, AND METHOD OF DRIVING THE LIGHT EMITTING DISPLAY DEVICE

(75) Inventors: Sang Moo Choi, Suwon (KR); Oh Kyong Kwon, Seoul (KR)

(73) Assignees: Samsung Mobile Display Co., Ltd., Yongin (KR); IUCF-HYU (Industry-University Cooperation Foundation Hanyang University, Seoul (KR)

( * ) Notice: Subject to any disclaimer, the term of this patent is extended or adjusted under 35 U.S.C. 154(b) by 866 days.

This patent is subject to a terminal disclaimer.

(21) Appl. No.: 11/404,560

(22) Filed: Apr. 13, 2006

(65) Prior Publication Data

US 2006/0245591 A1 Nov. 2, 2006

(30) Foreign Application Priority Data

Apr. 28, 2005 (KR) ..... 10-2005-0035755

(51) Int. Cl.
*G09G 3/30* (2006.01)

(52) U.S. Cl. ..... 345/76; 345/98; 345/100

(58) Field of Classification Search ..... 345/76, 345/98, 100

See application file for complete search history.

(56) References Cited

U.S. PATENT DOCUMENTS

| | | | | |
|---|---|---|---|---|
| 6,229,583 | B1 | 5/2001 | Yasunishi | |
| 2002/0149608 | A1* | 10/2002 | Bu et al. | 345/690 |
| 2003/0058233 | A1 | 3/2003 | Ahn et al. | |
| 2003/0090451 | A1* | 5/2003 | Ahn | 345/96 |
| 2004/0056852 | A1 | 3/2004 | Shih et al. | |
| 2004/0104873 | A1 | 6/2004 | Kang et al. | |
| 2004/0125067 | A1* | 7/2004 | Kim et al. | 345/98 |

(Continued)

FOREIGN PATENT DOCUMENTS

| | | |
|---|---|---|
| JP | 8-044313 | 2/1996 |

(Continued)

OTHER PUBLICATIONS

Patent Abstracts of Japan, Publication No. 09-024641; Publication Date: Jan. 28, 1997; in the name of Ichihara et al.

(Continued)

*Primary Examiner* — Richard Hjerpe
*Assistant Examiner* — Saifeldin Elnafia
(74) *Attorney, Agent, or Firm* — Christie, Parker & Hale, LLP

(57) ABSTRACT

A data driver adapted to display an image with substantially uniform brightness is provided. The data driver includes a holding latch unit including holding latches for storing data, a signal generator including digital-analog converters for receiving the data to generate data signals, a first switching unit provided between the holding latch unit and the signal generator, and a second switching unit coupled to the signal generator to transmit the data signals to data lines. The first switching unit couples the holding latches to the digital-analog converters during a horizontal period in a manner different from the manner in which the holding latches and the digital-analog converters are coupled to each other during a previous horizontal period. Therefore, errors of the digital-analog converters are diffused so that it is possible to display an image with substantially uniform brightness.

21 Claims, 11 Drawing Sheets

U.S. PATENT DOCUMENTS

| | | | | |
|---|---|---|---|---|
| 2004/0257356 | A1 | 12/2004 | Koyama | |
| 2005/0007315 | A1* | 1/2005 | Yang et al. | 345/76 |
| 2005/0024299 | A1 | 2/2005 | Abe et al. | |
| 2005/0110727 | A1* | 5/2005 | Shin | 345/76 |
| 2005/0156862 | A1* | 7/2005 | Hirayama et al. | 345/100 |
| 2005/0264495 | A1 | 12/2005 | Shin | |

FOREIGN PATENT DOCUMENTS

| | | | |
|---|---|---|---|
| JP | 9-24641 | | 1/1997 |
| JP | 10-319924 | A | 12/1998 |
| JP | 11-167373 | A | 6/1999 |
| JP | 2000-206936 | | 7/2000 |
| JP | 2001-056664 | | 2/2001 |
| JP | 2001-175228 | | 6/2001 |
| JP | 2001-242839 | | 9/2001 |
| JP | 2002-328644 | | 11/2002 |
| JP | 2002-328644 | A | 11/2002 |
| JP | 2003-140614 | | 5/2003 |
| JP | 2003-195812 | | 7/2003 |
| JP | 2003-255880 | | 9/2003 |
| JP | 2003-271097 | A | 9/2003 |
| JP | 2003-280616 | | 10/2003 |
| JP | 2004-272191 | | 9/2004 |
| KR | 10-2004-0021753 | | 3/2004 |
| KR | 10-2004-0041339 | | 5/2004 |
| KR | 10-2004-0077191 | | 9/2004 |
| KR | 10-2005-0051850 | | 6/2005 |

OTHER PUBLICATIONS

Patent Abstracts of Japan, Publication No. 2000-206936; Publication Date: Jul. 28., 2000; in the name of Kaida.

Korean Patent Abstracts, Publication No. 1020040041339; Publication Date: May 17, 2004; in the name of Park et al.

Korean Patent Abstracts, Publication No. 1020040077191; Publication Date: Sep. 4, 2004; in the name of Ha et al.

Japanese Office action dated Dec. 1, 2009, for Japanese application 2006-186960.

U.S. Office action dated Oct. 26, 2009, for related U.S. Appl. No. 11/518,042, noting U.S. references listed in this IDS.

Japanese Office action dated Mar. 23, 2010, for Japanese Patent application 2006-186960, noting listed reference in this IDS, as well as other Japanese references previously filed in an IDS dated Apr. 6, 2010.

U.S. Office action dated Jul. 29, 2010, for related U.S. Appl. No. 11/518,042, noting listed references in this IDS.

* cited by examiner

DATA DRIVER, LIGHT EMITTING DISPLAY DEVICE USING THE SAME, AND METHOD OF DRIVING THE LIGHT EMITTING DISPLAY DEVICE

CROSS-REFERENCE TO RELATED APPLICATIONS

This application claims priority to and the benefit of Korean Patent Application No. 10-2005-0035755, filed on Apr. 28, 2005, in the Korean Intellectual Property Office, the entire content of which is incorporated herein by reference.

BACKGROUND

1. Field of the Invention

The present invention relates to a data driver, a light emitting display device using the same, and a method of driving the light emitting display device, and more particularly to, a data driver adapted to display images with substantially uniform brightness, a light emitting display device using the same, and a method of driving the light emitting display device.

2. Discussion of Related Art

Recently, various flat panel display devices (FPD) with lower weight and volume than cathode ray tubes (CRT) have been developed. The FPDs include liquid crystal display devices (LCD), field emission display devices (FED), plasma display panels (PDP), and light emitting display devices.

Among the FPDs, the light emitting display devices display images using electroluminescent (EL) devices that generate light by re-combination of electrons and holes. The light emitting display device has high response speed and is driven with low power consumption.

The light emitting display device includes pixels positioned in the crossing areas between directions of data lines and scan lines. The pixels are selected when scan signals are supplied to the scan lines to charge the pixels with voltages corresponding to the data signals supplied to the data lines. The pixels supply currents corresponding to the charged voltages to the EL device to generate light of predetermined brightness. The light of the predetermined brightness that is emitted from each of the pixels forms a component of light and the components are combined to display a predetermined image in a display region.

Therefore, the light emitting display device includes a data driving part for supplying data signals to the data lines and a scan driver for supplying scan signals to the scan lines. The data driving part includes at least one data driver having predetermined channels.

FIG. 1 illustrates a conventional data driver 60. For the sake of convenience, in FIG. 1, it is assumed that the conventional data driver 60 includes j (j is a natural number) channels.

Referring to FIG. 1, the conventional data driver includes a shift register unit 1, a sampling latch unit 2, a holding latch unit 3, a signal generator 4, and an output stage 5.

The shift register unit 1 receives a source start pulse SSP and a source shift clock SSC from the outside. The shift register unit 1 sequentially generates j sampling signals while shifting the source start pulse SSP every one period of the source shift clock SSC. Therefore, the shift register unit 1 includes j shift registers 11 to 1*j*.

The sampling latch unit 2 sequentially stores data Data in response to sampling signals sequentially supplied from the shift register unit 1. Therefore, the sampling latch unit 2 includes j sampling latches 21 to 2*j* for storing j data Data.

The holding latch unit 3 receives the data Data from the sampling latch unit 2 to store the data Data. The holding latch unit 3 supplies the data Data stored therein to the signal generator 4. Therefore, the holding latch unit 3 includes j holding latches 31 to 3*j*.

The signal generator 4 receives the data Data supplied from the holding latch unit 3 to generate j data signals to correspond to the received data Data. Therefore, the signal generator 4 includes j digital-analog converters (DAC) 41 to 4*j*. That is, the signal generator 4 generates j data signals using the DACs 41 to 4*j* provided in the channels to supply the generated data signals to the output stage 5.

The output stage 5 supplies the j data signals supplied from the signal generator 4 to j data lines D1 to Dj. Then, the data signals are supplied to the pixels so that a predetermined image is displayed.

However, according to the conventional data driver, it is generally not possible to generate uniform data signals due to deviation in the DACs 41 to 4*j* provided in the channels. Actually, even if manufacturing processes are precisely controlled when the DACs 41 to 4*j* are manufactured, the DACs 41 to 4*j* typically have deviation of about ±3 mV. Therefore, although the data Data having the same gray scale values are input to the DACs 41 to 4*j*, data signals having different voltage values (or current values) are generated. As described above, when the data signals having different voltage values (or current values) are generated when the same gray scale values are input to the DACs 41 to 4*j*, an image with non-uniform brightness is displayed on the light emitting display device. In particular, when the DACs 41 to 4*j* having high deviation are adjacent to each other, noise in the form of vertical lines is additionally generated.

Therefore, there is a need for reducing the non-uniformity in image brightness that is caused by non-uniformity in fabrication and processing of the digital to analog converters used in data drivers of light emitting display devices.

SUMMARY OF THE INVENTION

Accordingly, the present invention provides a data driver adapted to display images with substantially uniform brightness, a light emitting display device using the same, and a method of driving the light emitting display device. The data driver drives the light emitting display device during frames of time that are divided into horizontal periods. One frame may include one or more horizontal periods.

According to an aspect of the present invention, there is provided a data driver comprising a holding latch unit including holding latches for storing data, a signal generator including digital-analog converters for receiving the data to generate data signals, a first switching unit provided between the holding latch unit and the signal generator, and a second switching unit coupled to the signal generator to transmit the data signals to data lines. The first switching unit couples the holding latches to the digital-analog converters during a present horizontal period in a manner different from the manner in which the holding latches and the digital-analog converters are coupled to each other during a previous horizontal period.

The signal generator may for example include the digital-analog converters whose number is larger than the number of holding latches by at least one. The first switching unit shifts the data to the left or right during a previous horizontal period and does not shift the data during the present horizontal period.

According to another aspect of the present invention, there is provided a light emitting display device comprising a scan driver for driving scan lines, a data driving part for driving data lines, and a display region including pixels coupled to the scan lines and the data lines. The data driving part comprises a holding latch unit including holding latches for storing data, a signal generator including digital-analog converters for receiving the data to generate data signals, a first switching unit provided between the holding latch unit and the signal generator, and a second switching unit coupled to the signal generator to transmit the data signals to data lines. The first switching unit couples the holding latches to the digital-analog converters during the present horizontal period in a manner different from the manner in which the holding latches and the digital-analog converters are coupled to each other during a previous horizontal period.

According to another aspect of the present invention, there is provided a method of driving a light emitting display device, the method including generating data signals using digital-analog converters, supplying the data signals to pixels via data lines, and generating predetermined light components by the pixels to correspond to the data signals. The digital-analog converter for supplying a data signal to a specific data line during a present horizontal period is different from the digital-analog converter for supplying the data signal to the specific data line during a previous horizontal period.

The generating of the data signals may for example include storing data in holding latches, shifting the data stored in the holding latches during at least one horizontal period between two adjacent horizontal periods to supply the data to the digital-analog converters, generating the data signals using the data, and shifting the data signals in at least one horizontal period between the two horizontal periods to supply the data signals to the data lines.

BRIEF DESCRIPTION OF THE DRAWINGS

These and/or other aspects and features of the invention will become apparent and more readily appreciated from the following description of the exemplary embodiments, taken in conjunction with the accompanying drawings of which.

DETAILED DESCRIPTION

Hereinafter, exemplary embodiments of the present invention will be described with reference to the accompanying FIGS. 2 to 7.

Figure 1:
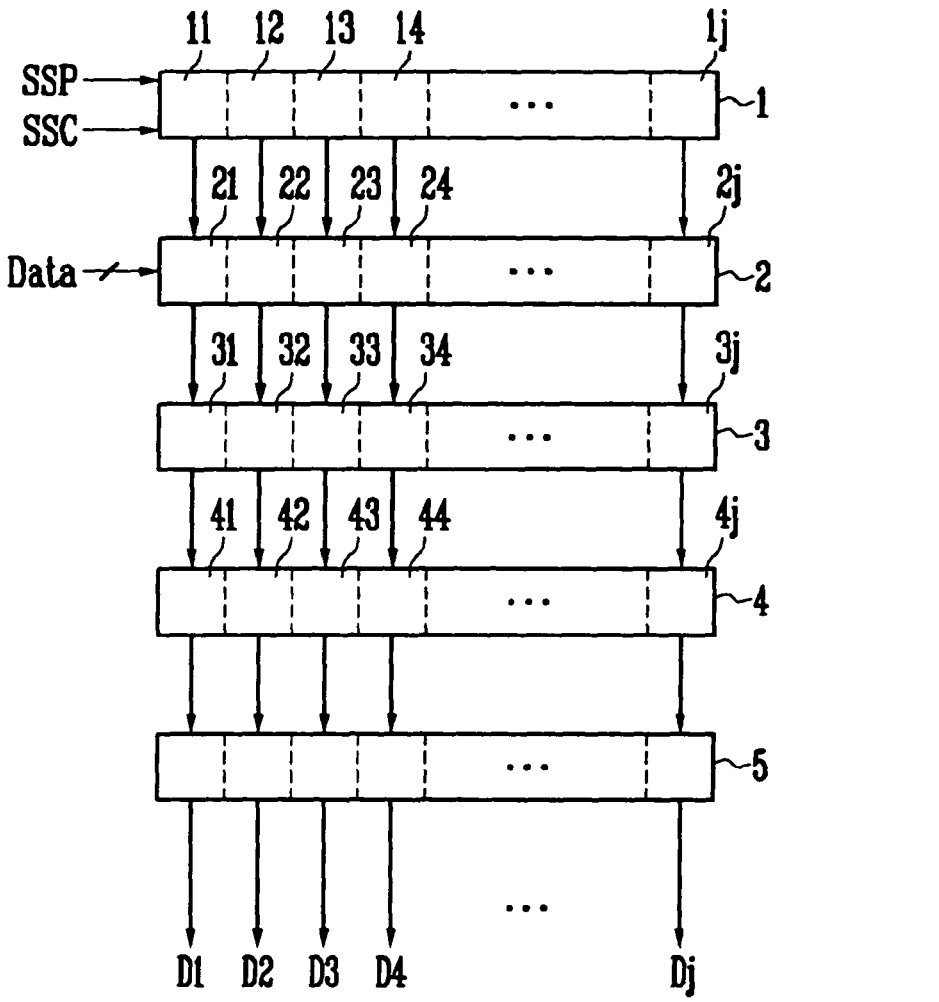
FIG. 1 (PRIOR ART)
FIG. 1 illustrates a conventional data driver.
Figure 2:
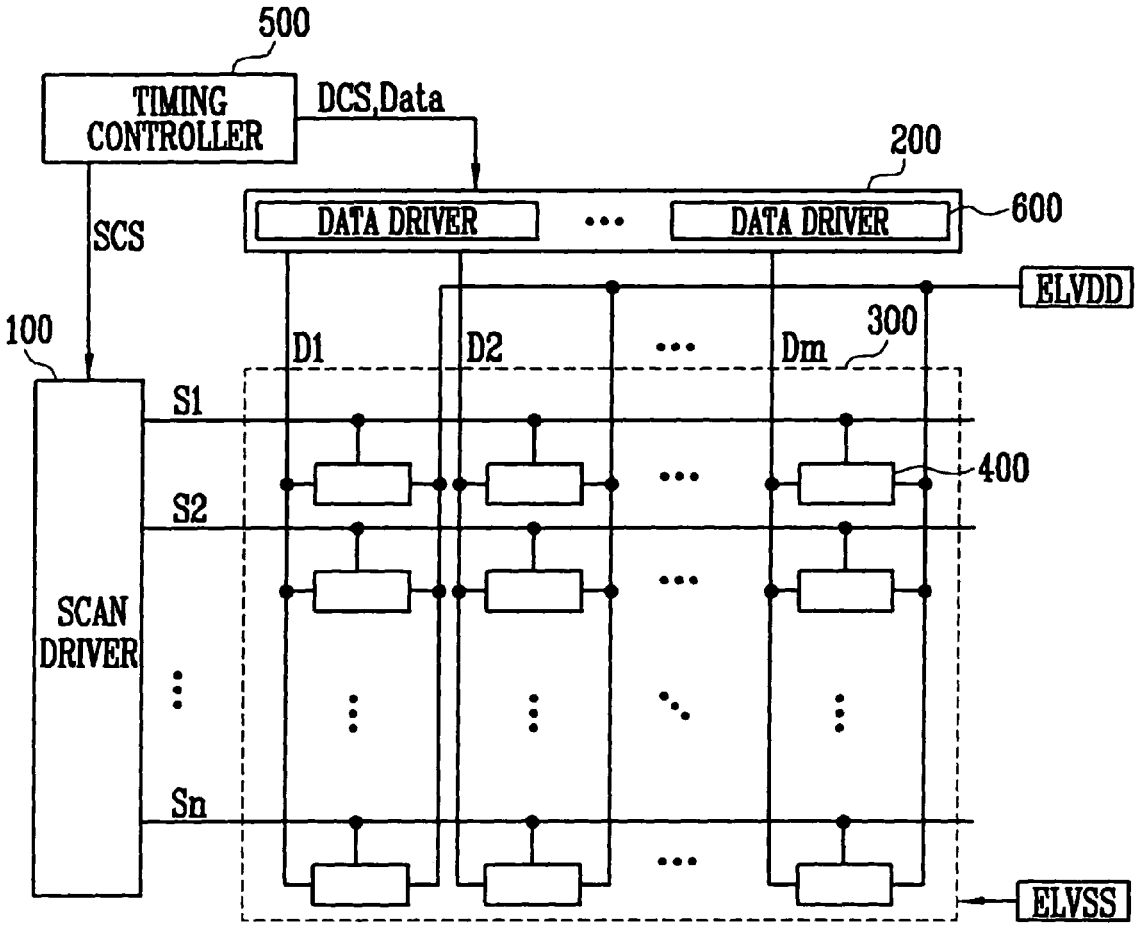
FIG. 2 illustrates a light emitting display device according to an embodiment of the present invention.

FIG. 2 illustrates a light emitting display device according to an embodiment of the present invention.

Referring to FIG. 2, the light emitting display device according to the embodiment of the present invention includes a display region 300 including pixels 400 coupled to scan lines S1 to Sn and data lines D1 to Dm, a scan driver 100 for driving the scan lines S1 to Sn, a data driving part 200 for driving the data lines D1 to Dm, and a timing controller 500 for controlling the scan driver 100 and the data driving part 200.

The timing controller 500 generates data driving control signals DCS and scan driving control signals SCS in response to synchronizing signals supplied from the outside. The data driving control signals DCS generated by the timing controller 500 are supplied to the data driving part 200 and the scan driving control signals SCS generated by the timing controller 500 are supplied to the scan driver 100. The timing controller 500 also supplies data Data supplied from the outside to the data driving part 200.

The scan driver 100 receives the scan driving control signals SCS from the timing controller 500. The scan driver 100 sequentially supplies scan signals to the scan lines S1 to Sn. That is, the scan driver 100 selects the pixels 400 to which the data signals are supplied while sequentially supplying the scan signals to the scan lines S1 to Sn.

The data driving part 200 receives the data driving control signals DCS and the data Data from the timing controller 500. The data driving part 200 then generates predetermined currents or voltages as data signals to correspond to the gray scale values of the data Data. Here, when predetermined voltages are generated as the data signals, the data driving part 200 supplies the data signals to the pixels 400 selected by the scan signals. When predetermined currents are generated as the data signals, the data driving part 200 receives the predetermined currents from the pixels 400 selected by the scan signals (i.e., the data driving part 200 operates as a current sink). Therefore, the data driving part 200 includes at least one data driver 600. The data driver 600 drives the pixels 400 during frames. Each frame period may be divided into one or more horizontal periods. The structure of the data driver 600 will be described in detail later.

The display region 300 includes the pixels 400 formed at the crossing areas between the directions of the scan lines S1 to Sn and the data lines D1 to Dm. The pixels 400 receive first power from a first power source ELVDD and second power from a second power source ELVSS. In some embodiments, the second power source may be at ground voltage or may not be included at all. The pixels 400 are charged to predetermined voltages corresponding to the data signals and supply currents corresponding to the charged voltages from the first power source ELVDD to the second power source ELVSS via an electroluminescent device (not shown) so that an image of predetermined brightness is displayed.

Figure 3:
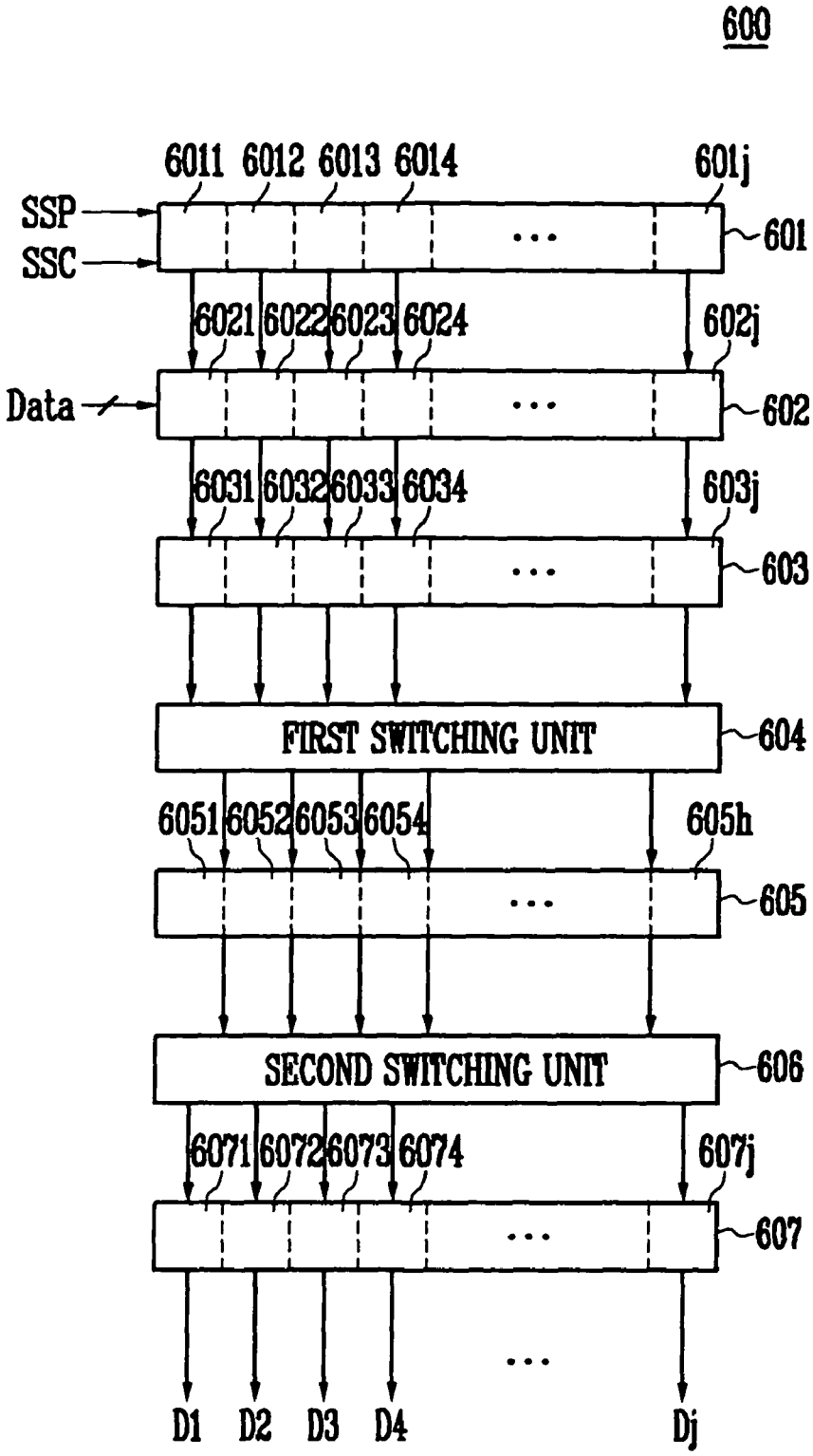
FIG. 3 illustrates an example of the data driver illustrated in FIG. 2.

FIG. 3 illustrates a data driver according to a first embodiment of the present invention. In FIG. 3, for the sake of convenience, it is assumed that the data driver 600 includes j channels.

Referring to FIG. 3, the data driver 600 according to the first embodiment of the present invention includes a shift register unit 601, a sampling latch unit 602, a holding latch unit 603, a first switching unit 604, a signal generator 605, a second switching unit 606, and an output stage 607.

The shift register unit 601 receives a source start pulse SSP and a source shift clock SSC from the outside. The shift register unit 601 then sequentially generates j sampling signals while shifting the source start pulse SSP every one period of the source shift clock SSC. Therefore, the shift register unit 601 includes j shift registers 6011 to 601*j*.

The sampling latch unit 602 sequentially stores data Data in response to sampling signals sequentially supplied from the shift register unit 601. Therefore, the sampling latch unit 602 includes j sampling latches 6021 to 602*j* for storing j data Data. Here, the storage capacities of the sampling latches

6021 to 602*j* are set so that the sampling latches 6021 to 602*j* can store the data Data of predetermined bits.

The holding latch unit 603 receives the data Data from the sampling latch unit 602 to store the data Data. The holding latch unit 603 supplies the data Data stored therein to the first switching unit 604. Therefore, the holding latch unit 603 includes j holding latches 6031 to 603*j*. Here, the storage capacities of the holding latches 6031 to 603*j* are set so that the holding latches 6031 to 603*j* can store the data Data of predetermined bits.

The first switching unit 604 receives the data Data from the holding latch unit 603. The first switching unit 604 then transmits the data Data to the signal generator 605. At this time, the first switching unit 604 couples the holding latches 6031 to 603*j* to different DACs 6051 to 605*h* every horizontal period. For example, the first switching unit 604 may couple the first holding latch 6031 to the first DAC 6051 during a $k^{th}$ (k is a natural number) horizontal period and may couple the first holding latch 6031 to the second DAC 6052 during a $(k+1)^{th}$ horizontal period.

This way, the signal generator 605 receives the data Data from the first switching unit 604 and generates data signals to correspond to the received data Data. Therefore, the signal generator 605 includes h (h is a natural number no less than j) DACs 6051 to 605*h*. Here, the number of DACs 6051 to 605*h* included in the signal generator 605 is no less than j. Detailed description thereof will follow.

The DACs 6051 to 605*h* included in the signal generator 605 generate predetermined currents or voltages to correspond to the gray scale values of the data Data. The signal generator 605 then supplies the generated data signals to the second switching unit 606. When voltage data signals are generated by the signal generator 605, the output stage 607 includes buffers 6071 to 607*j*. On the other hand, when current data signals are generated by the signal generator 605, the output stage 607 includes sample/hold circuits 6071 to 607*j*.

The second switching unit 606 receives data signals from the signal generator 605. The second switching unit 606 then couples the DACs 6051 to 605*j* to different buffers 6071 to 607*j* or to different sample/hold circuits 6071 to 607*j* every horizontal period. For example, the second switching unit 606 may couple the first buffer 6071 (or the first sample/hold circuit 6071) to the first DAC 6051 during the $k^{th}$ horizontal period and may couple the first buffer 6071 (or the first sample/hold circuit 6071) to the second DAC 6052 during the $(k+1)^{th}$ horizontal period. Actually, the second switching unit 606 controls the connection between the signal generator 605 and the output stage 607 so that the data signal generated by the data Data stored in the $i^{th}$ (i is a natural number) holding latch 603*i* can be supplied to the $i^{th}$ buffer 607*i* (or the $i^{th}$ sample/hold circuit 607*i*).

The output stage 607 receives j data signals from the second switching unit 606. When current data signals are supplied from the second switching unit 606, the sample/hold circuits 6071 to 607*j* provided in the output stage 607 charge the pixels with voltages corresponding to the current data signals supplied to the pixels by the data lines. The sample/hold circuits 6071 to 607*j* then receive predetermined currents from the pixels 400 via the data lines D1 to Dj that correspond to the voltages charged in the pixels. In other words, the sample/hold circuits 6071 to 607*j* operate as current sinks. On the other hand, when voltage data signals are supplied from the second switching unit 606, then these voltage data signals are supplied to the data lines D1 to Dj via the buffers 6071 to 607*j*.

Figure 4A:
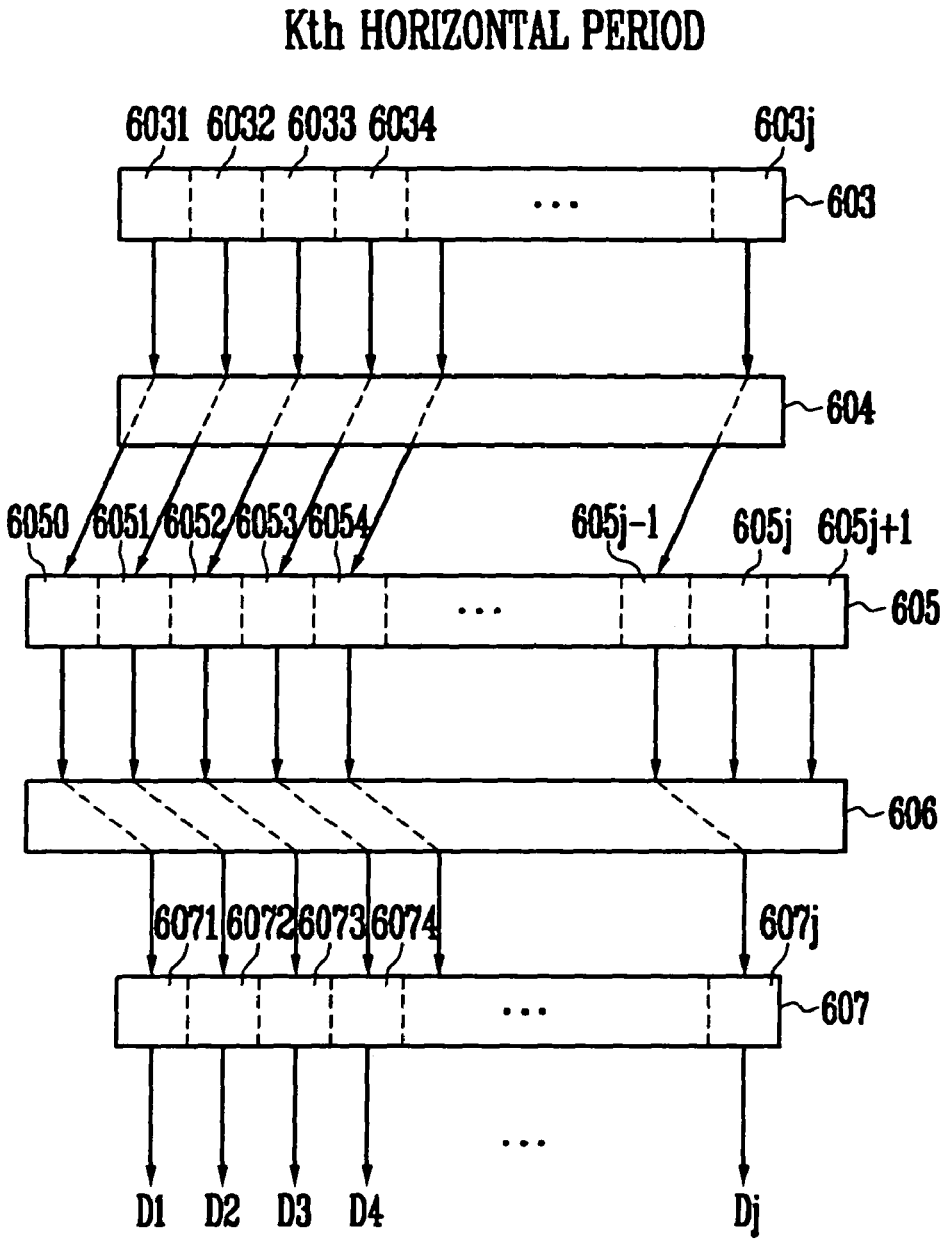
FIGS. 4A to 4C illustrate an example of the operation processes of the first and second switching units illustrated in FIG. 3.
Figure 4B:
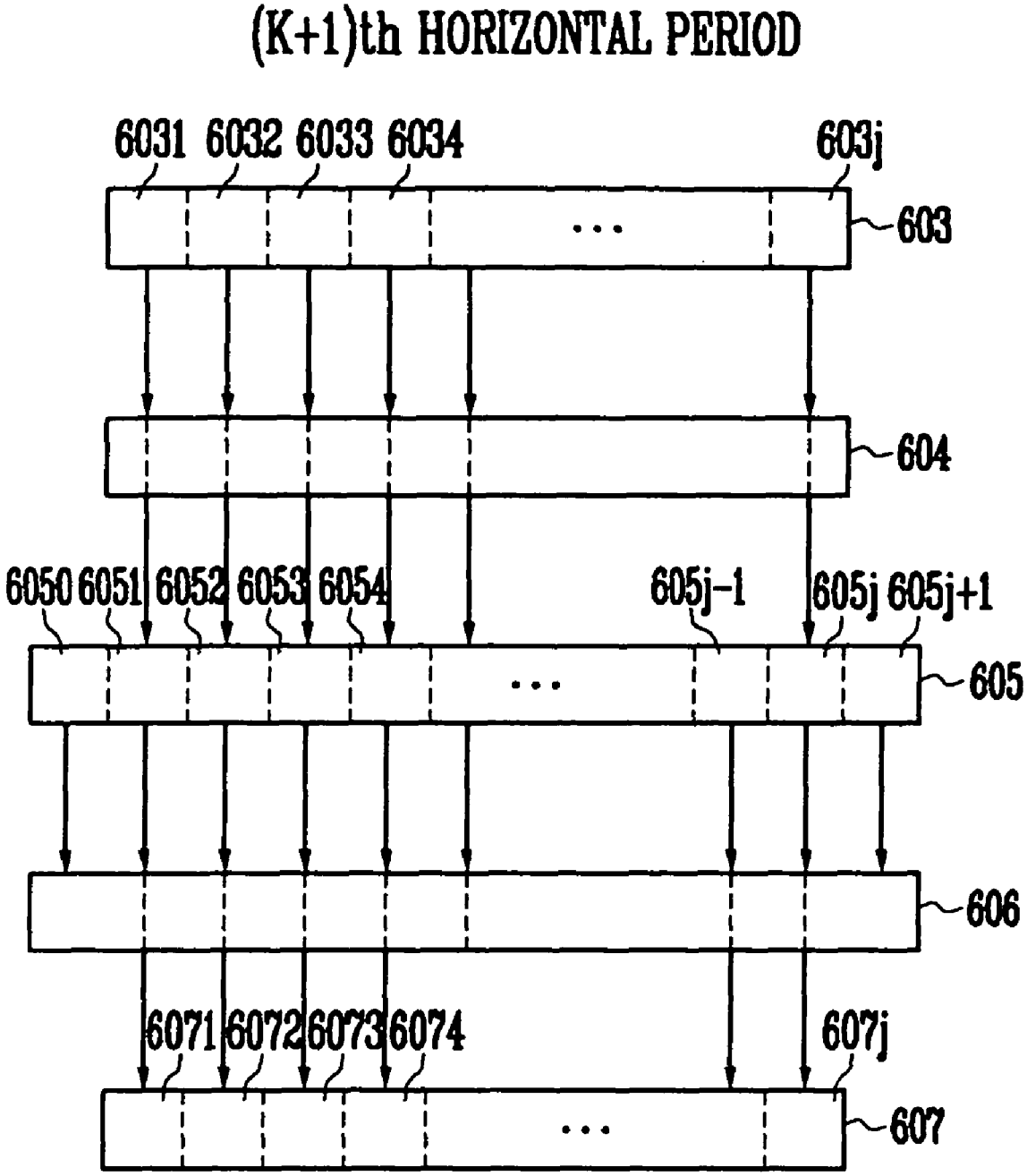
Figure 4C:
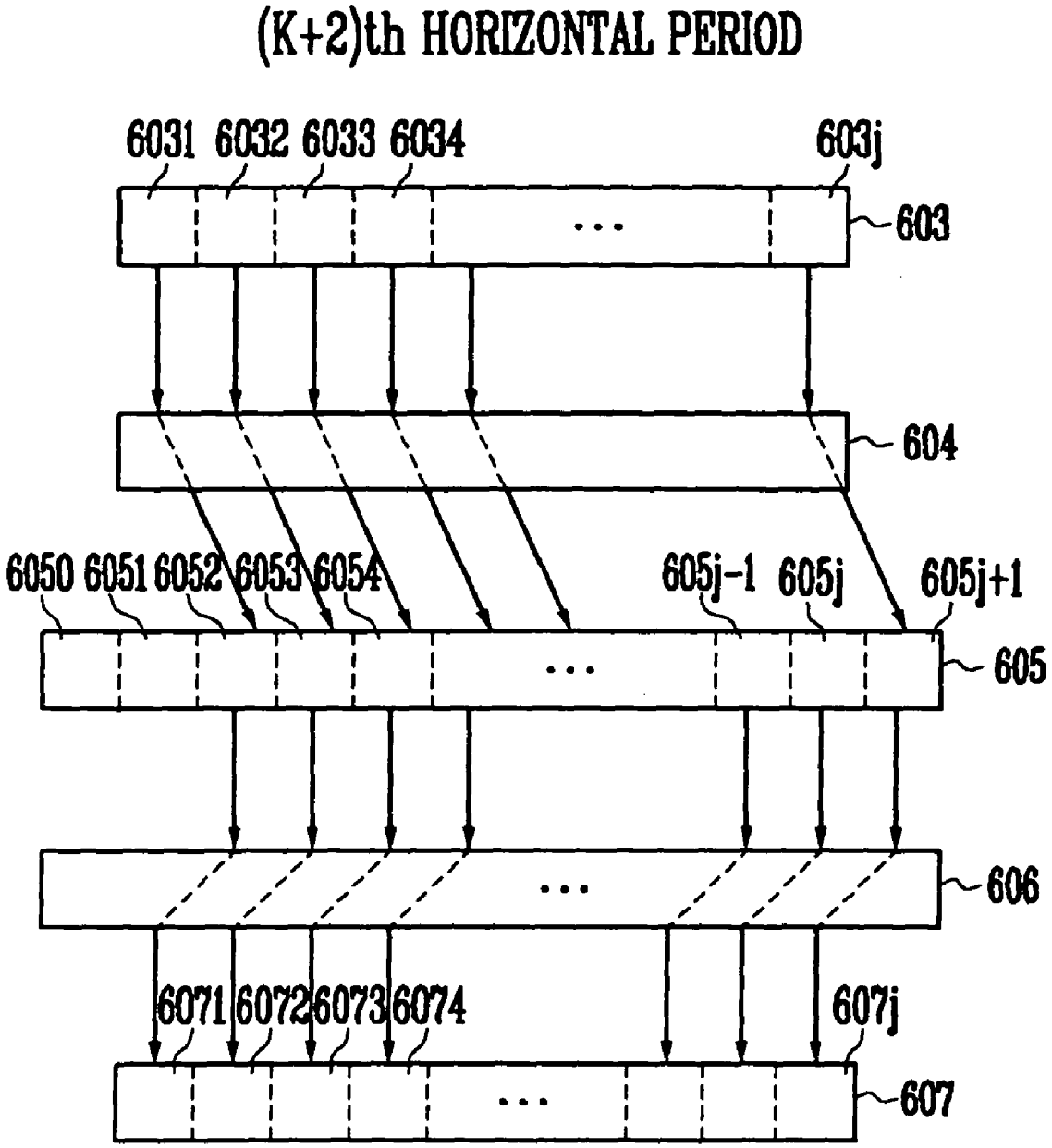

FIGS. 4A to 4C illustrate an example of the operation of the first and second switching units 604, 606. Here, it is assumed that DACs 6050 to 605*j*+1 whose number is larger than the number of channels by two are included in the signal generator 605. For example, when the data driver 600 is coupled to 100 data lines D1 to D100, then 102 DACs are included in the signal generator 605.

Referring to FIGS. 4A to 4C, during the $k^{th}$ horizontal period, the first switching unit 604 shifts the data Data stored in the holding latches 6031 to 603*j* by one channel to the left to supply the data Data to the DACs 6050 to 605*j*−1. Then, the DACs 6050 to 605*j*−1 generate current data signals or voltage data signals to correspond to the data Data supplied thereto to supply the current data signals or the voltage data signals to the second switching unit 606. At this time, the second switching unit 606 shifts the current data signals or the voltage data signals supplied from the DACs 6050 to 605*j*−1 by one channel to the right to supply the current data signals or the voltage data signals to the output stage 607. That is, the second switching unit 606 controls the connection between the signal generator 605 and the output stage 607 so that the data signal generated by the data supplied from the $i^{th}$ holding latch can be supplied to the $i^{th}$ data line.

During the $(k+1)^{th}$ horizontal period, the first switching unit 604 supplies the data Data stored in the holding latches 6031 to 603*j* to the DACs 6051 to 605*j* provided in the original channel as illustrated in FIG. 4B. Then, the DACs 6051 to 605*j* generate current data signals or voltage data signals to correspond to the data Data supplied thereto to supply the current data signals or the voltage data signals to the second switching unit 606. At this time, the second switching unit 606 supplies the data signals output from the DACs 6051 to 605*j* to the output stage 607 without shifting the data signals.

During the $(k+2)^{th}$ horizontal period, the first switching unit 604 shifts the data Data stored in the holding latches 6031 to 603*j* by one channel to the right to supply the data Data to the DACs 6052 to 605*j*+1 as illustrated in FIG. 4C. Then, the DACs 6052 to 605*j*+1 generate current data signals or voltage data signals to correspond to the data supplied thereto to supply the current data signals or the voltage data signals to the second switching unit 606. At this time, the second switching unit 606 shifts the current data signals or the voltage data signals supplied from the DACs 6052 to 605*j*+1 by one channel to the left to supply the current data signals or the voltage data signals to the output stage 607.

As described above, in the data driver according to the present invention, the DAC coupled to a specific holding latch during the $k^{th}$ horizontal period is different from the DAC coupled to a specific holding latch during the $(k+1)^{th}$ horizontal period. Therefore, the data signals supplied to the data lines D1 to Dj during each horizontal period, are generated by DACs that are different from the DACs generating the data signals provided during the previous horizontal period. As described above, when the DACs generating the data signals being supplied to the data lines D1 to Dj during each horizontal period are different from the DACs generating the data signals of the previous horizontal period, then the display region 300 can display an image with substantially uniform brightness.

In other words, the DACs generating the data signals are varied from one horizontal period to the next, in order to reduce or prevent the non-uniformity existing among the DACs due to their fabrication process to impact the brightness of the image. That is, when the data signals generated by the DACs each having their own deviation are supplied to different data lines D1 to Dj every horizontal period, error is diffused so that it is possible to display an image with substantially uniform brightness. On the other hand, according to the present invention, the connection processes of the switching units 604 and 606 are not limited to the contents illustrated in FIGS. 4A to 4C but may vary so that the data signals generated by the DACs different from the DACs of the previous horizontal period can be supplied to the data lines D1 to Dj every successive horizontal period.

Figure 5A:
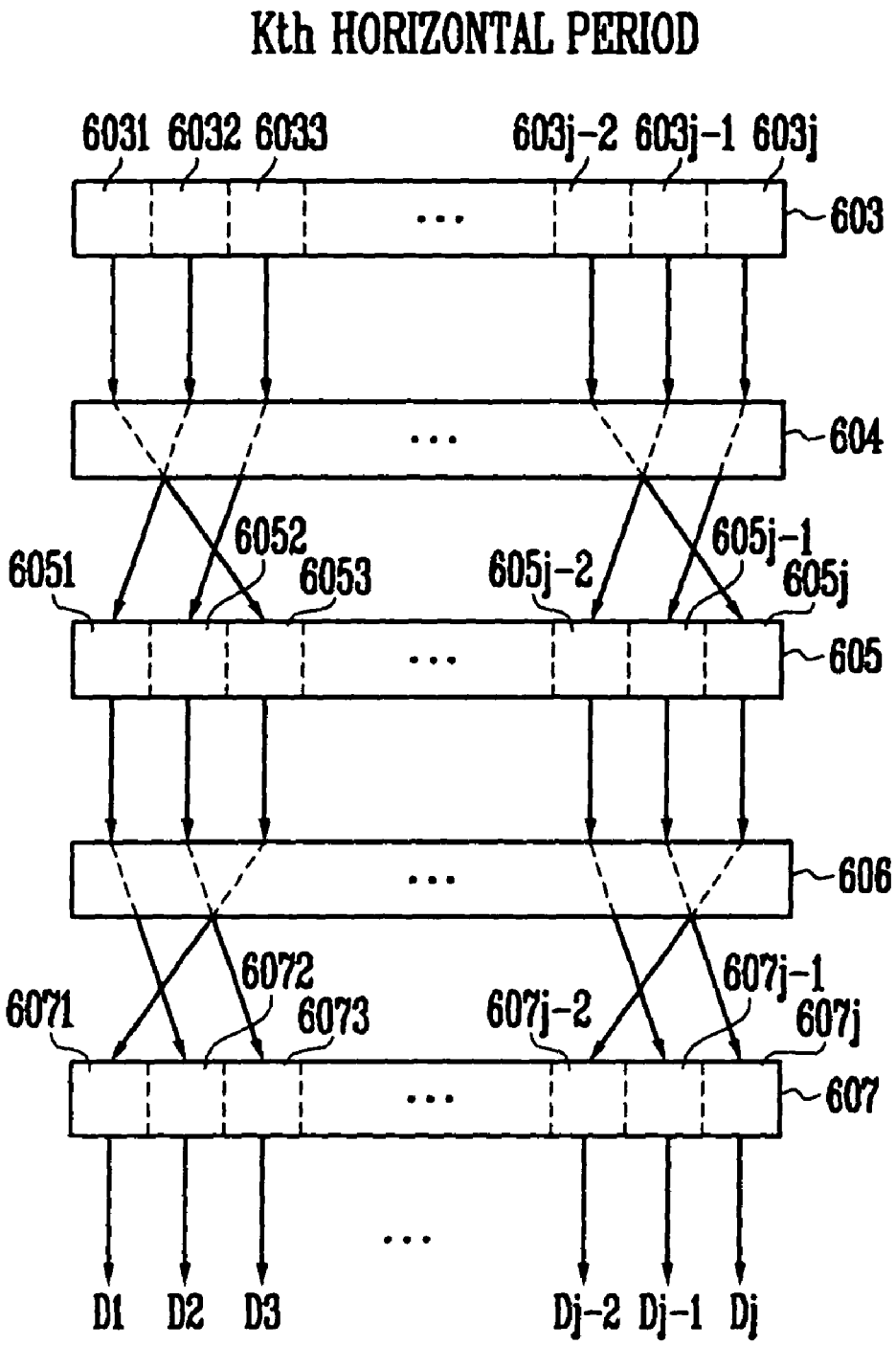
FIGS. 5A to 5C illustrate another example of the operation processes of the first and second switching units illustrated in FIG. 3.
Figure 5B:
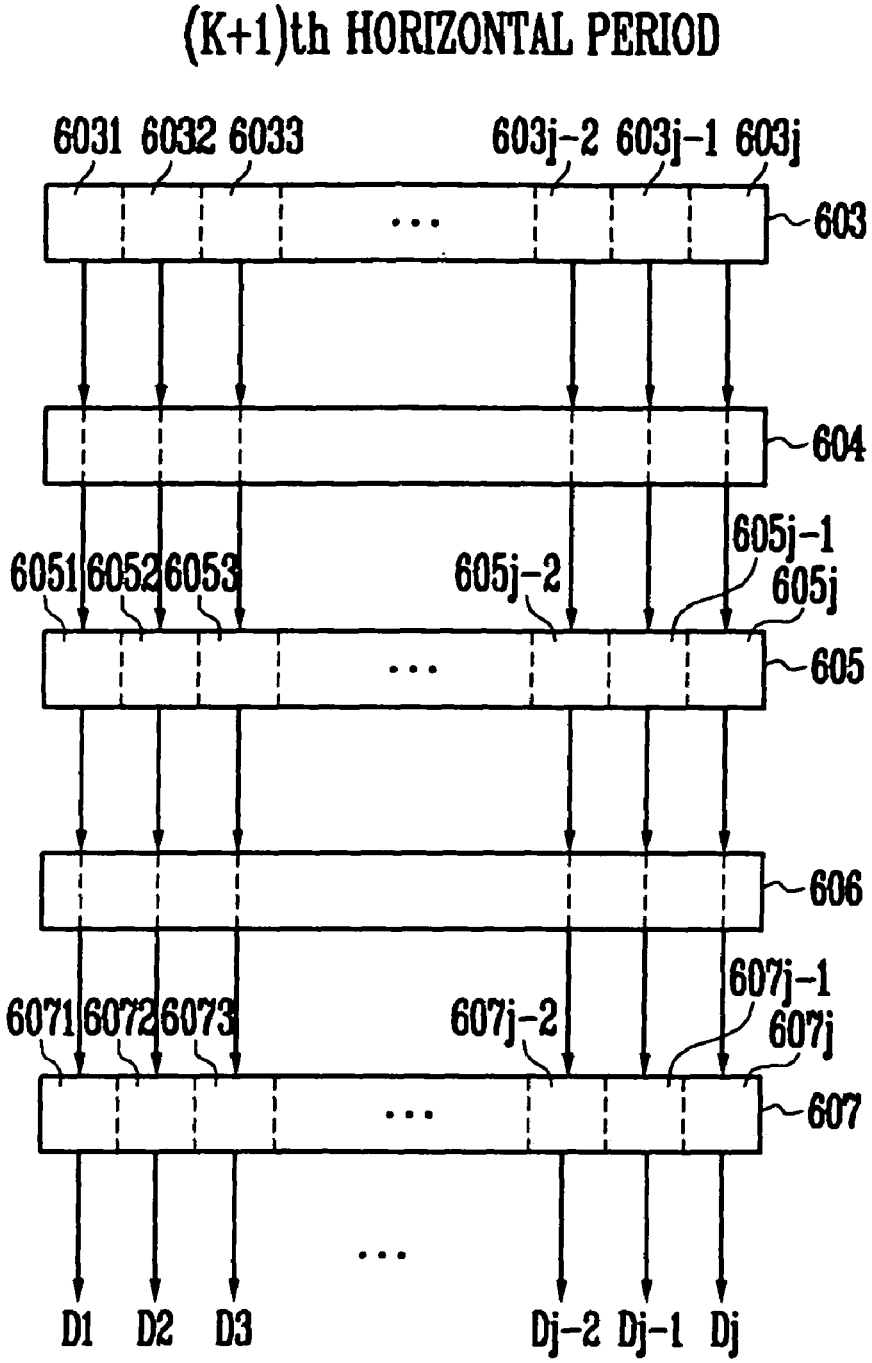
Figure 5C:
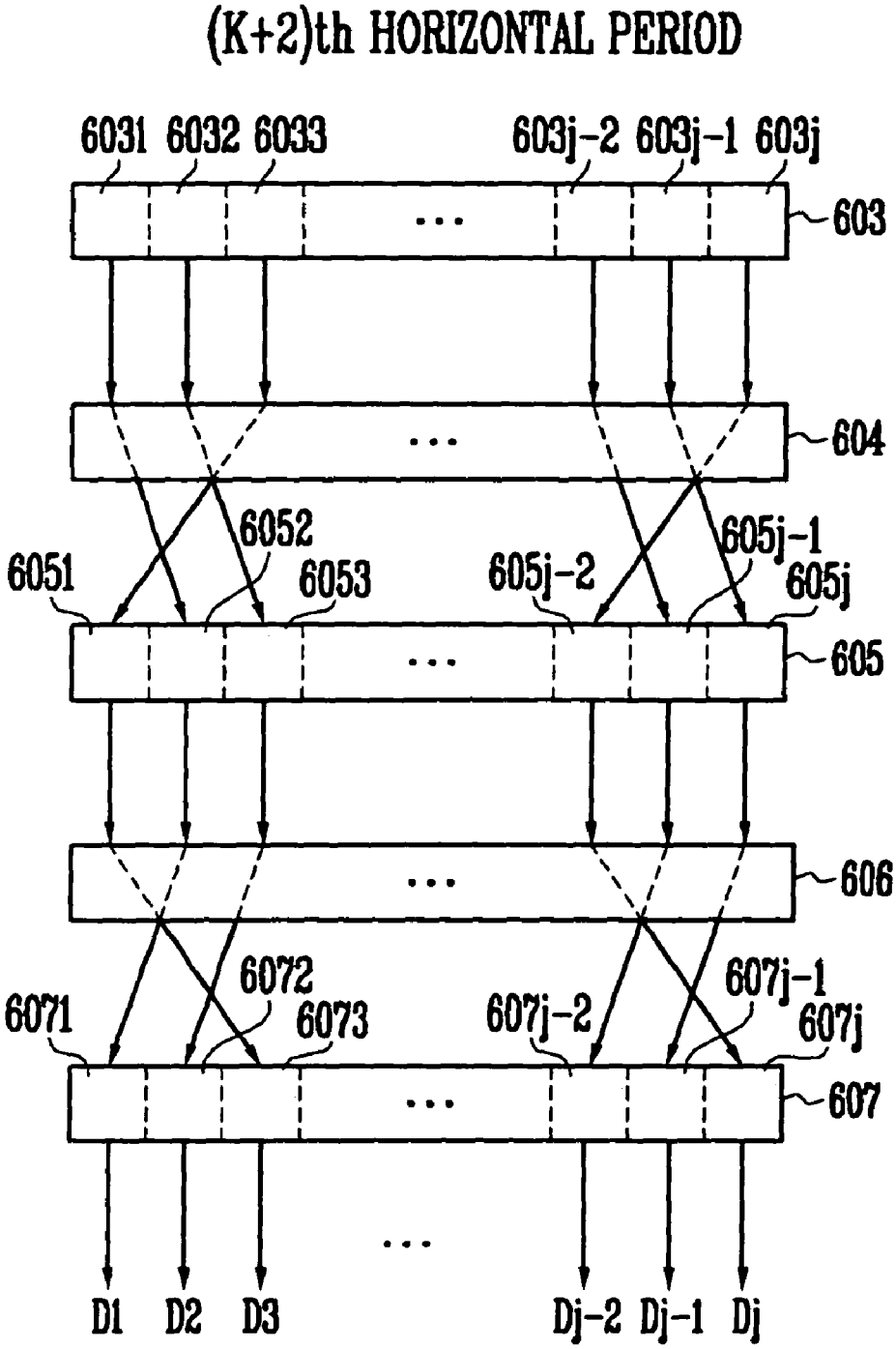

FIGS. 5A to 5C illustrate another embodiment of the operation processes of the first and second switching units 604, 606. Here, it is assumed that the DACs 6051 to 605*j* whose number is the same as the number of channels are included in the signal generator 605.

Referring to FIGS. 5A to 5C, during the $k^{th}$ horizontal period, the first switching unit 604 shifts the data Data stored in some of the holding latches, for example, 6031 and 603*j*−2by two channels to the right and shifts the data Data stored in the remaining holding latches, for example 6032, 6033 . . . 603*j*−3, 603*j*−1 and 603*j*, by one channel to the left to supply the data Data to the DACs 6051 to 605*j*. Then, the DACs 605 to 605*j* generate current data signals or voltage data signals that correspond to the data Data supplied thereto to supply the data Data to the second switching unit 606. Then, the second switching unit 606 shifts some of the data signals among the current data signals or the voltage data signals supplied to the DACs 6051 to 605*j* by two channels to the left and shifts the remaining data signals by one channel to the right before supplying the data signals to the output stage 607. That is, the second switching unit 606 controls the connection between the signal generator 605 and the output stage 607 so that the data signal generated by the data supplied from the $i^{th}$ holding latch can be supplied to the $i^{th}$ data line.

During the $(k+1)^{th}$ horizontal period, the first switching unit 604 supplies the data Data stored in the holding latches 6031 to 603*j* to the DACs 6051 to 605*j* provided in the original channel without shifting the data Data as illustrated in FIG. 5B. Then, the DACs 6051 to 605*j* generate current data signals or voltage data signals to correspond to the data Data supplied thereto and supply the current data signals or the voltage data signals to the second switching unit 606. At this time, the second switching unit 606 supplies the data signals supplied from the DACs 6051 to 605*j* to the output stage 607 without shifting the data signals.

During the $(k+2)^{th}$ horizontal period, the first switching unit 604 shifts the data Data stored in some of the holding latches, for example 6033 and 603*j* by two channels to the left and shifts the data Data stored in the remaining holding latches, for example 6031, 6032, 6034 . . . 603*j*−1, by one channel to the right to supply the data Data to the DACs 6051 to 605*j*. Then, the DACs 6051 to 605*j* generate current data signals or voltage data signals that correspond to the data Data supplied thereto and supply the data Data to the second switching unit 606. At this time, the second switching unit 606 shifts some data signals among the current data signals or the voltage data signals supplied to the DACs 6051 to 605*j* by two channels to the right and shifts the remaining data signals by one channel to the left to supply the data signals to the output stage 607.

As described above, in the data driver 600 according to the present invention, the connection between the holding latch unit 603 and the signal generator 605 during the $k^{th}$ horizontal period is different from the connection between the holding latch unit 603 and the signal generator 605 during the $(k+1)^{th}$ horizontal period. Therefore, the data signal supplied to a data line D1 during each horizontal period, is generated by a DAC that is different from the DAC generating the signal provided to the same data line during the previous horizontal period. As described above, when the data signals generated by DACs different from the DACs of the previous horizontal period are supplied to the data lines D1 to Dj every horizontal period, the display region 300 can display an image with substantially uniform brightness.

That is, when the data signals generated by a DACs having a deviation are supplied to different data lines D1 to Dj every horizontal period, error due to the deviation of the DAC is diffused so that it is possible to display an image with substantially uniform brightness. On the other hand, according to the present invention, the connection processes of the switching units 604 and 606 are not limited to the contents illustrated in FIGS. 5A to 5C but may vary so that the data signals generated by DACs that are different from the DACs generating the data signals during a horizontal period can be supplied to the data lines D1 to Dj during a next horizontal period.

Figure 6:
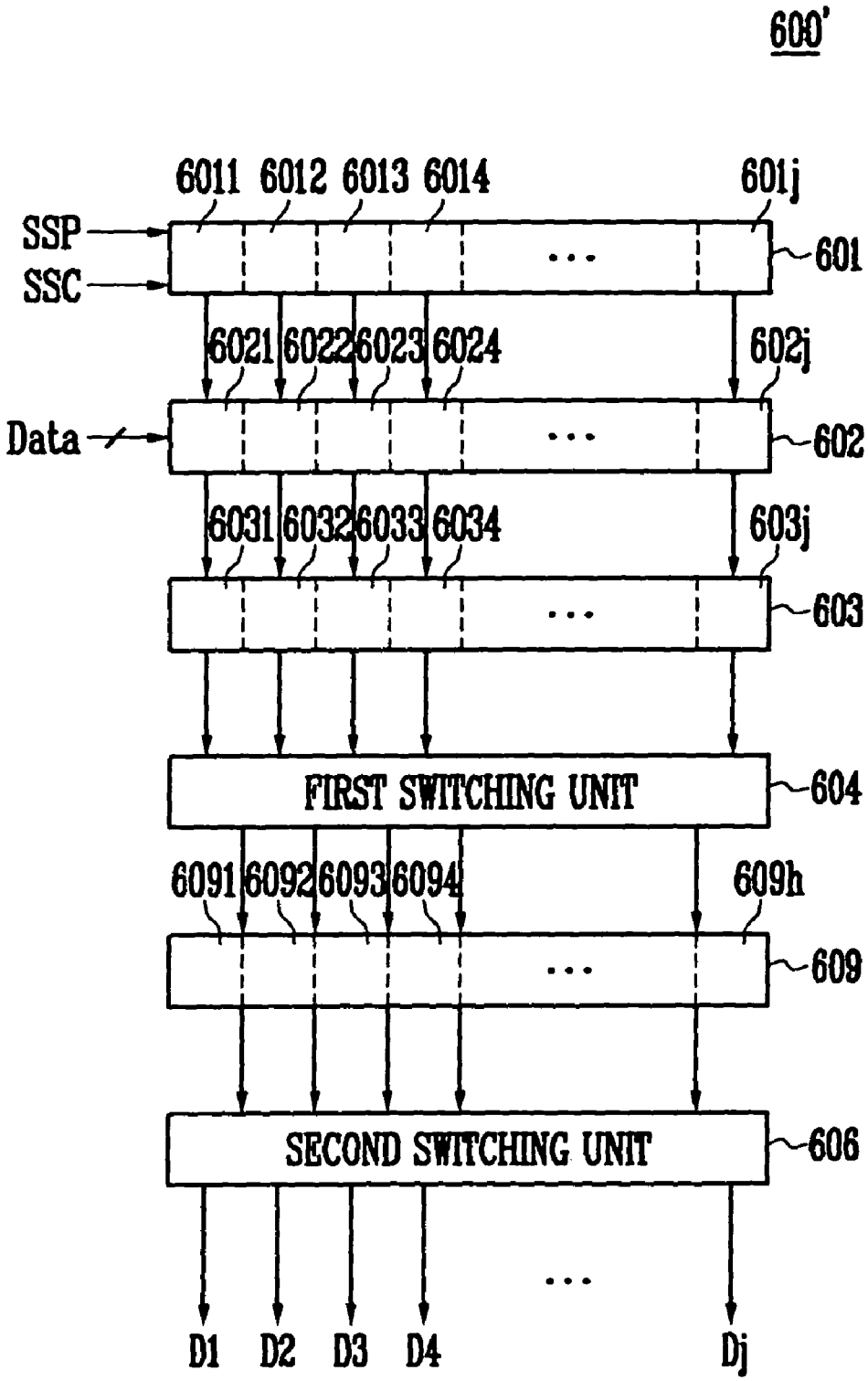
FIG. 6 illustrates another example of the data driver illustrated in FIG. 2.

FIG. 6 illustrates a data driver 600' according to a second embodiment of the present invention. In FIG. 6, elements also appearing in FIG. 3 are denoted by the same reference numerals and their detailed description is omitted.

Referring to FIG. 6, in the data driver 600' according to the second embodiment of the present invention, a signal generator 609 generates current data signals to correspond to the data Data supplied from the first switching unit 604. Therefore, the signal generator 609 includes DACs 6091 to 609*h*. The DACs 6091 to 609*h* then receive currents from the pixels 400 via the second switching unit 606 and the data lines D1 to Dj. In other words, these DACs operate as current sinks. Then, the pixels 400 generate light components of predetermined brightness to correspond to the currents supplied to the data driver 600.

The structure of the second embodiment 600' of the present invention is the same as the structure of the first embodiment 600 with the exception that the DACs 6091 to 609*h* included in the signal generator 609 of the second embodiment 600' receive the currents from the pixels 400 via the second switching unit 606 and the data lines D1 to Dj. Therefore, in the second embodiment 600' of the present invention, the output stage 607 is omitted and the second switching unit 606 is directly coupled to the data lines D1 to Dj. Otherwise, the operation of the first and second switching units 604 and 606 are the same as the operations illustrated in FIGS. 4A to 4C or FIGS. 5A to 5C.

Figure 7:
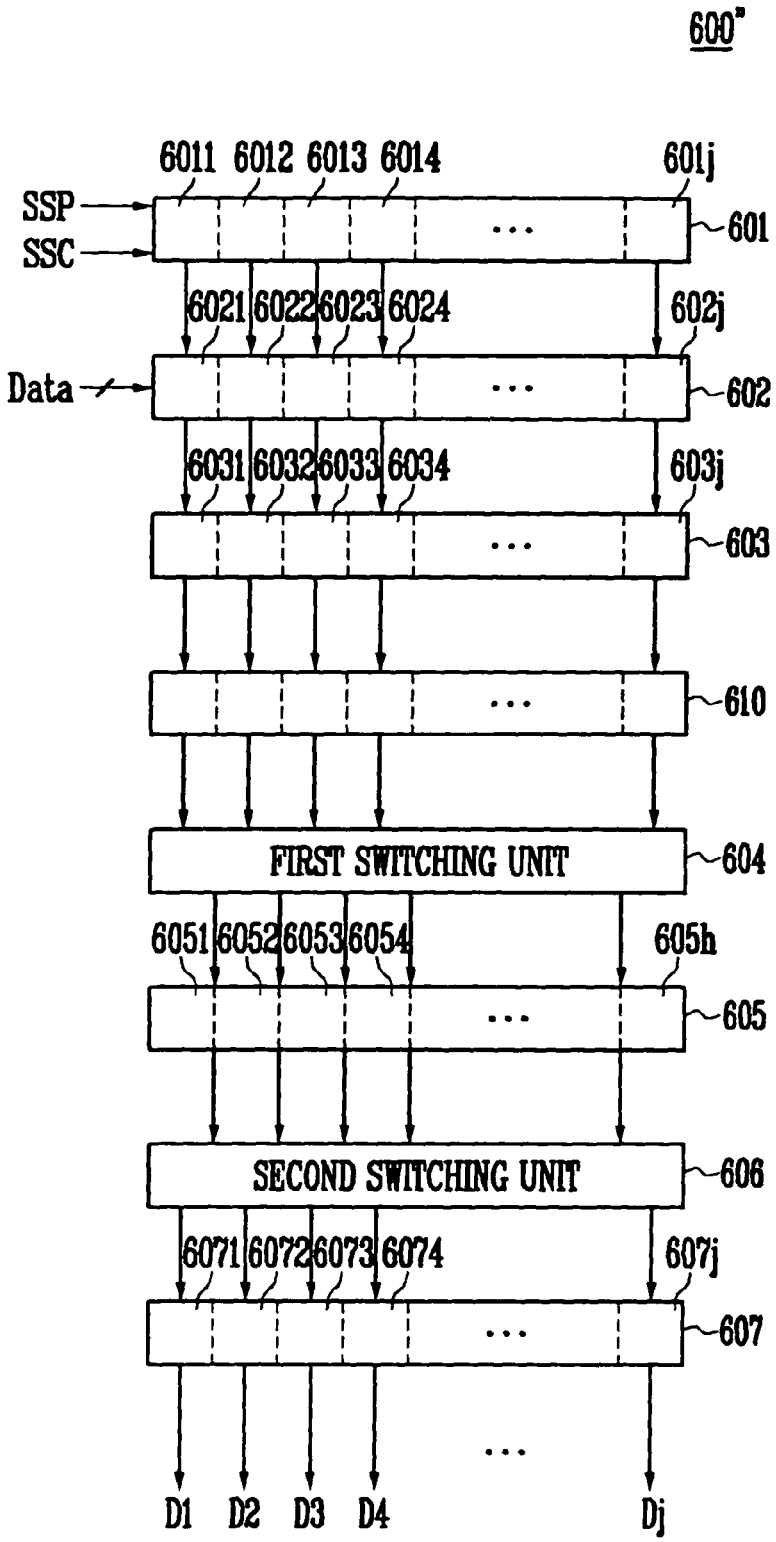
FIG. 7 illustrates still another example of the data driver illustrated in FIG. 2.

FIG. 7 illustrates a data driver 600" according to a third embodiment of the present invention. In FIG. 7, elements also shown in FIG. 3 are denoted by the same reference numerals and their detailed description is omitted.

Referring to FIG. 7, the data driver 600" according to the third embodiment of the present invention further includes a level shifter unit 610 coupled to the holding latch unit 603. The level shifter unit 610 increases the voltage level of the data Data supplied from the holding latch unit 603 before supplying the data Data to the first switching unit 604. When the data Data having a high voltage level is supplied from an external system to the data driver 600, circuit parts tolerant of the high voltage level must be provided in the light emitting display device so that the manufacturing expenses are increased. Therefore, data Data having a low voltage level is supplied from the outside of the data driver 600 and the data Data having the low voltage level is shifted to a high voltage level by the level shifter unit 610. Then, circuit parts corresponding to a low voltage level can be used in the light emitting display device so that it is possible to reduce manufacturing expenses.

As described above, in the data driver according to the embodiments of the present invention, the light emitting display device using the same, and the method of driving the light emitting display device, the connection between the holding latch unit and the signal generator during a horizontal period is different from the connection between the holding latch unit and the signal generator during the next horizontal period. Therefore, the data signals supplied to the data lines during each horizontal period are generated by DACs that are different from the DACs generating the data signals supplied during the previous or next horizontal period. In this manner, errors caused by the DACs are diffused and it is possible to display an image with substantially uniform brightness.

Although exemplary embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A light emitting display device having scan lines, data lines, and a display region including pixels coupled to the scan lines and the data lines, the device further comprising:

a scan driver for driving the scan lines; and a data driver for driving the data lines during frames, the frames being divided into horizontal periods, wherein the data driver comprises:

a sampling latch unit including sampling latches for sampling data;

a holding latch unit including holding latches for storing the data sampled by the sampling latch;

a signal generator including digital-to-analog converters for receiving the data and for generating data signals;

a first switch between the holding latch unit and the signal generator; and a second switch coupled to the signal generator and for transmitting the data signals to the data lines, wherein the first switch couples at least one of the holding latches to a different one of the digital-to-analog converters during one of the horizontal periods than that during a previous one of the horizontal periods, wherein the number of the digital-to-analog converters is larger than the number of the holding latches, and wherein the first switch shifts at least a part of the data in a first direction by one or more channels during a first one of the horizontal periods, does not shift the data during a second one of the horizontal periods, and shifts at least a part of the data in a second direction opposite the first direction by one or more channels during a third one of the horizontal periods.

2. The light emitting display device as claimed in claim 1, wherein the second switch transmits a data signal generated by the data stored in an $i^{th}$ holding latch to an $i^{th}$ data line, i being a natural number.

3. A data driver for driving a light emitting display device during frames divided into horizontal periods, the light emitting display device including data lines coupled to pixels adapted to emit light, the data driver comprising:

a sampling latch unit including sampling latches for sampling data;

a holding latch unit including holding latches for storing the data sampled by the sampling latch;

a signal generator including digital-to-analog converters for receiving the stored data and for generating data signals;

a first switch provided between the holding latch unit and the signal generator for transmitting the data signals from the holding latches to the digital-to-analog converters; and a second switch coupled to the signal generator for transmitting the data signals from the digital-to-analog converters to the data lines, wherein the first switch couples at least one of the holding latches to a different one of the digital-to-analog converters during one of the horizontal periods than that during a previous one of the horizontal periods, wherein the number of the digital-to-analog converters is larger than the number of the holding latches, and wherein the first switch shifts at least a part of the data in a first direction by one or more channels during a first one of the horizontal periods, does not shift the data during a second one of the horizontal periods, and shifts at least a part of the data in a second direction opposite the first direction by one or more channels during a third one of the horizontal periods.

4. The data driver as claimed in claim 3, wherein the first switch shifts the data during the one of the horizontal periods and does not shift the data during the previous one of the horizontal periods.

5. The data driver as claimed in claim 3, wherein a number of the digital-to-analog converters is equal to a number of the holding latches.

6. The data driver as claimed in claim 5, wherein the first switch shifts a first portion of the stored data left and shifts a remaining portion of the stored data other than the first portion of the stored data right during the one of the horizontal periods and does not shift the stored data during the previous one of the horizontal period.

7. The data driver as claimed in claim 3, wherein the second switch transmits a data signal generated from a data in an $i^{th}$ holding latch to an $i^{th}$ data line, i being a natural number.

8. The data driver as claimed in claim 3, wherein the digital-to-analog converters generate data signals of predetermined voltages corresponding to the data.

9. The data driver as claimed in claim 8, further comprising an output stage including buffers provided between the second switching unit and the data lines.

10. The data driver as claimed in claim 3, wherein the digital-to-analog converters generate data signals of predetermined currents corresponding to the stored data.

11. The data driver as claimed in claim 10, further comprising an output stage including sample/hold circuits provided between the second switch and the data lines to charge the pixels with voltages corresponding to the data signals and to receive currents corresponding to the charged voltages via the data lines.

12. The data driver as claimed in claim 3, wherein the digital-to-analog converters receive predetermined currents corresponding to the stored data via the second switch and the data lines.

13. The data driver as claimed in claim 3, further comprising:

a shift register for sequentially generating sampling signals; and a sampling latch for storing the stored data in response to the sampling signals and for supplying the stored data to the holding latch unit.

14. The data driver as claimed in claim 3, further comprising a level shifter for increasing a voltage level of the stored data stored in the holding latch unit.

15. A method of driving a light emitting display device during frame periods, each frame divided into horizontal periods, the device having data lines, scan lines, and a display region including pixels coupled to the scan lines and the data lines, the method comprising:

supplying data to sampling latches for sampling the data;

storing the data sampled by the sampling latch using holding latches;

supplying data from the holding latches to a first switch to provide the data to digital-to-analog converters, wherein the number of the digital-to-analog converters is larger than the number of the holding latches;

generating data signals using the digital-to-analog converters;

supplying the data signals generated by the digital-to-analog converters to the data lines to provide the data signals to the pixels; and generating predetermined light components corresponding to the data signals using the pixels, wherein one of the digital-to-analog converters for supplying one of the data signals to a specific data line during one horizontal period is different from another one of the digital-to-analog converters for supplying another one of the data signals to the specific data line during a previous horizontal period, and wherein the first switch shifts at least a part of the data in a first direction by one or more channels during a first one of the horizontal periods, does not shift the data during a second one of the horizontal periods, and shifts at least a part of the data in a second direction opposite the first direction by one or more channels during a third one of the horizontal periods.

16. The method as claimed in claim 15, wherein the generating of the data signals comprises:

storing data in holding latches;

shifting the stored data between two consecutive horizontal periods, in at least one group of two consecutive horizontal periods, and supplying the shifted data to the digital-to-analog converters;

generating the data signals using the shifted data; and shifting the data signals between the two consecutive horizontal periods in the at least one group and supplying the shifted data signals to the data lines.

17. The method as claimed in claim 16, wherein the shifting of the stored data comprises:

shifting the stored data during one horizontal period; and not shifting the stored data during a following horizontal period.

18. The method as claimed in claim 16, wherein the shifting of the stored data comprises:

shifting a first portion of the stored data left and shifting a remaining portion of the stored data other than the first portion of the stored data right during one horizontal period; and not shifting the stored data during a following horizontal period.

19. The method as claimed in claim 16, wherein the shifting of the data signals between the two consecutive horizontal periods causes a data signal stored in an $i^{th}$ holding latch to be transmitted to an $i^{th}$ data line, i being a natural number.

20. A light emitting display device having scan lines, data lines, and a display region including pixels coupled to the scan lines and the data lines, the device further comprising:

a scan driver for driving the scan lines; and a data driver for driving the data lines during frames, the frames being divided into horizontal periods, wherein the data driver comprises:

a holding latch unit including holding latches for storing data;

a signal generator including digital-to-analog converters for receiving the data and for generating data signals;

a first switch between the holding latch unit and the signal generator; and a second switch coupled to the signal generator and for transmitting the data signals to the data lines, wherein the first switch couples at least one of the holding latches to a different one of the digital-to-analog converters during one of the horizontal periods than that during a previous one of the horizontal periods, and wherein during a first one of the horizontal periods, the first switch shifts at least a part of the data in a first direction by one or more channels and shifts at least another part of the data in a second direction opposite the first direction by one or more channels, does not shift the data during a second one of the horizontal periods, and during a third one of the horizontal periods, shifts at least a part of the data in the first direction by one or more channels and shifts at least another part of the data in the second direction by one or more channels.

21. The light emitting display device as claimed in claim 20, wherein during the first one of the horizontal periods, the second switch shifts at least a part of the data in the first direction by one or more channels and shifts at least another part of the data in the second direction by one or more channels, does not shift the data during the second one of the horizontal periods, and during the third one of the horizontal periods, shifts at least a part of the data in the first direction by one or more channels and shifts at least another part of the data in the second direction by one or more channels.

* * * * *

UNITED STATES PATENT AND TRADEMARK OFFICE

CERTIFICATE OF CORRECTION

PATENT NO. : 7,982,691 B2
APPLICATION NO. : 11/404560
DATED : July 19, 2011
INVENTOR(S) : Sang Moo Choi It is certified that error appears in the above-identified patent and that said Letters Patent is hereby corrected as shown below:

In the Claims

| | |
|---|---|
| Column 10, Claim 6, line 26. | Delete "period"<br>Insert -- periods -- |
| Column 11, Claim 15, line 1. | After "supplying"<br>Insert -- the -- |

Signed and Sealed this
Thirty-first Day of July, 2012

David J. Kappos

David J. Kappos
*Director of the United States Patent and Trademark Office*